United States Patent [19]

Gannon

[11] 4,196,073

[45] Apr. 1, 1980

[54] HYDROPHILIC THIO COMPOUNDS AS SELECTIVE DEPRESSANTS IN THE FLOTATION SEPARATION OF COPPER AND MOLYBDENUM

[75] Inventor: David J. Gannon, St. Bruno, Canada

[73] Assignee: Canadian Industries Limited, Montreal, Canada

[21] Appl. No.: 888,167

[22] Filed: Mar. 20, 1978

[30] Foreign Application Priority Data

Apr. 22, 1977 [CA] Canada ..... 276821

[51] Int. Cl.[2] ..... B03D 1/02

[52] U.S. Cl. ..... 209/167

[58] Field of Search ..... 209/166, 167

[56] References Cited

U.S. PATENT DOCUMENTS

| | | | |
|---|---|---|---|
| 1,952,907 | 3/1934 | Christmann | 209/166 |
| 1,960,459 | 5/1934 | Ruth | 209/167 |
| 2,449,984 | 9/1948 | Gibbs | 209/167 |
| 3,329,266 | 7/1967 | Cox | 209/167 |
| 3,400,817 | 9/1968 | Burwell | 209/167 |
| 3,788,467 | 1/1974 | Werneke | 209/167 |

FOREIGN PATENT DOCUMENTS

| | | | |
|---|---|---|---|
| 347749 | 6/1920 | Fed. Rep. of Germany | 209/166 |
| 347750 | 6/1920 | Fed. Rep. of Germany | 209/166 |
| 314822 | 7/1929 | United Kingdom | 209/166 |
| 617944 | 2/1949 | United Kingdom | 209/166 |

*Primary Examiner*—Robert Halper

*Attorney, Agent, or Firm*—Guy Drouin

[57] ABSTRACT

A process for separating molybdenite from copper sulphide and other metal sulphide minerals with which it is associated in a metallurgical concentrate through use of a copper sulphide depressant which is a compound having at least one nitrogen atom, at least one thio group and at least one hydrophilic group. Some examples are 2-thiouracil, pseudothio-hydantoin, and 2-imino-4-oxo-5-thiazolidineacetic acid.

5 Claims, No Drawings

HYDROPHILIC THIO COMPOUNDS AS SELECTIVE DEPRESSANTS IN THE FLOTATION SEPARATION OF COPPER AND MOLYBDENUM

This invention relates to froth flotation processes for recovering molybdenite from mineral concentrates containing same. It is more particularly concerned with a process wherein molybdenum sulphide is froth floated while other sulphides, mainly copper sulphide, with which it occurs are depressed by means of a novel class of selective depressants.

Molybdenite is very often found in copper sulphide ores wherein it is present in minor quantities together with sulphides of other metals such as iron, zinc and lead. Such ores in their natural state have the molybdenum, copper and other metals containing minerals associated with large amounts of host rock or gangue from which the valuable mineral content must be converted into a form suitable for further processing.

The concentration of the mineral content is usually achieved by froth flotation, in which the raw ore is finely ground and frothed in water containing certain additives which assist in concentrating the metallic ore particles in the froth whilst allowing the gangue to sink. The froth then collected constitutes a concentrate from which the mineral values, notably molybdenum and copper sulphides, are separated from each other by further froth flotation. To assist in the separation of the two sulphides, agents known as frothers, collectors and depressants are added to the water employed in said further froth flotation.

Frothers are added to cause formation of a froth in which the molybdenite concentrate collects. Typical frothers are pine oil, and higher aliphatic alcohols such as 4-methyl-2-pentanol.

Collectors are agents which assist the assimilation of molybdenite concentrate particles in the froth. Widely used as collectors for molybdenite are hydrocarbon oils such as kerosene and fuel oil.

Depressants are agents used to ensure as far as possible that copper sulphide and other metal sulphides do not collect in the froth with the molybdenum sulphide concentrate. Chemical compounds known to selectively depress copper sulphide are sodium thiophosphate generally called the "Nokes" reagent and described in Nokes et al. U.S. Pat. No. 2,811,255 granted on 29th Oct., 1957, thioglycollic acid disclosed in H. L. Gibbs U.S. Pat. No. 2,449,984 granted on 28th Sept., 1948, and thioglycerol taught in M. F. Werneke's U.S. Pat. No. 3,785,488 issued on 15th Jan., 1974. The "Nokes" reagent, although efficient, is very seldom used because of its hazardous character. Indeed, sodium thiophosphate is a compound which, under certain conditions, can break down very rapidly to yield substantial amounts of hydrogen sulphide, a hazardous and toxis pollutant. Thioglycollic acid suffers from the disadvantages that it must be used in relatively large amounts and becomes progressively ineffective at pH values higher than 9. Thioglycerol and sodium hydrosulphide, another depressant in wide use today also require to be used in large quantities. In addition sodium hydrosulphide constitutes a safety hazard in that it may liberate hydrogen sulphide under certain conditions.

The present invention is concerned with improved depressants for use in the froth flotation of molybdenite from concentrates of copper and molybdenum sulphides. The improved depressants comprise a group of compounds characterized in that their molecule contains at least one nitrogen atom, at least one thio group and at least one hydrophilic group.

A process is thus provided for separating molybdenite from copper sulphide and other metal sulphide minerals with which it is associated in a metallurgical concentrate, which comprises depressing the copper sulphide and other metal sulphide minerals with from about 0.1 to about 5.0 pounds per ton of concentrate solids of a reagent selected from 2-thiouracil, 6-amino-2-thiouracil, 6-methyl-2-thiouracil, 2-thiobarbituric acid, thioorotic acid, 2-thiohydantoin, pseudo-thiohydantoin, solubilized pseudothiocyanogen, 2-imino-4-oxo-5-thiazolidineacetic acid, D-glucose thiourea adduct, cysteine, methionine, amidinothioacetic acid, amidinothioethane sulphonic acid, 2-mercapto-3-pyridinol, trithiocyanuric acid, dithiooxamide, rhodanine N-acetic acid, N-aminorhodanine, thioparabanic acid and any alkali metal or acid salts of these, selectively floating molybdenite from the copper sulphide and other metal sulphide minerals and recovering the resulting flotation concentrate.

By D-glucose thiourea adduct is meant a mixture of N-$\beta$-D-glucopyranosylthiourea and N-N'di-$\beta$-D-glucopyranosylthiourea obtained by reacting glucose and thiourea according to the method of B. Helferich and W. Kosche, Ber. 59 B, 69–79 (1926).

By alkali metal salts it is meant to include the sodium, potassium or ammonium salts and, by acid salts it is meant to include the hydrochloric, sulphuric and nitric acid salts.

For all concentrates the novel reagents of the invention achieve molybdenum grades and recoveries equivalent to those obtained by using a much higher dose of sodium hydrosulphide and give generally better results than those obtained by using equivalent doses of thioglycollic acid or thioglycerol. Among the novel reagents, those which have been found most effective are 2-thiouracil, 6-amino-2-thiouracil, 6-methyl-2-thiouracil, 2-thiobarbituric acid, thioorotic acid, 2-thiohydantoin, pseudohydantoin, solubilized pseudothiocyanogen, 2-imino-4-oxo-5-thiazolidine acetic acid, D-glucose thiourea adduct and any alkali metal or acid salts of these. These preferred reagents are generally effective in as low a range as 0.1 to 1.0 pound per ton of concentrate solids although they may require to be used in larger amounts for the odd concentrates. Particularly preferred are 2-thiouracil, pseudothiohydantoin, solubilized pseudothiocyanogen and 2-imino-4-oxo-5-thiazolidineacetic acid.

The other reagents, namely, cysteine, methionine, amidinothioacetic acid, amidinothioethane sulphonic acid, 2-mercapto-3-pyridinol, trithiocyanuric acid, dithiooxamide, rhodanine N-acetic acid, N-amino-rhodanine, thioparabanic acid and their alkali metal or acid salts are less effective than those indicated above as preferred but still exhibit good depressant activity as will be demonstrated hereinafter. These reagents which, for some concentrates, may be effective at an addition level of as little as 0.1 pound per ton, in general have been found to require amounts of up to 5.0 pounds per ton of concentrate solids.

The mechanism of depression by the reagents of the invention has not been determined. However, a tentative explanation which is not to be considered as limiting the invention herein disclosed and claimed, is that the reagents are able to function as a bidentate or tridentate ligand and replace the xanthate (or other collector molecule) from the surface of the copper mineral. The hydrophilic nature of the reagents renders the copper mineral surface hydrophilic and thus depresses it. Molybdenite has a layer structure and is naturally hydrophobic. It thus has little tendency of absorbing the hydrophilic reagents of the invention and is not depressed.

The concentrates used in the process of the invention can either be rougher concentrates or preferably cleaner concentrates. As is well known in the art, a rougher concentrate is that resulting from a first froth flotation of a raw ore while a cleaner concentrate is one resulting from a further flotation fractionation of a rougher concentrate.

The conditions of the process, aside from the particular doses of depressant set out hereinabove, are conventional and thus are not critical. Thus a suitable metallurgical concentrate is prepared as a 15 to 50% aqueous slurry in a flotation cell and, if necessary, the pH of the latter is adjusted to lie within the range of 8 to 12 by addition of lime, caustic soda or any other suitable alkaline material. A novel depressant of the present invention is then added to the slurry in the above indicated amount of 0.1 to 5.0 pounds per ton of concentrate solids and the slurry is thereafter conditioned until copper sulphide is no longer floated to the surface. Conditioning usually takes from 1 to 20 minutes. A collector generally selected from hydrocarbon oils such as kerosene and fuel oil is also added in an amount of 0.2 to 5.0 pounds per ton of concentrate solids to assist in the flotation of molybdenum sulphide. If necessary, a suitable frother such as 4-methyl-2-pentanol can be added to the slurry in an amount of up to 0.3 pound per ton of concentrate solids. In general flotation requires from 2 to 10 minutes.

Although the depressants of the invention can be introduced into the slurry as solids, they are preferably added as aqueous solutions. Whereas some of the reagents are readily soluble in water, others are more readily soluble when in the presence of an alkali or of an acid. For these other reagents it is thus indicated to render the solutions slightly alkaline or acid as the case may be.

Exceptionally, pseudothiocyanogen is not soluble in water and must be solubilized by warming with sodium hydroxide. This dissolution, as reported by A. P. Antykos, Zhurnal Prikladnoi Khimii, Vol. 40, No. 11 pages 2547 to 2552, is accompanied by reaction to a mixture of compounds of the type

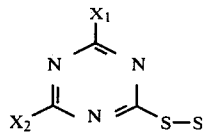

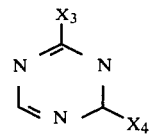

and

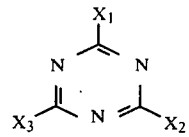

wherein X1, X2, X3 and X4 may be—SH or —OH.

The invention is illustrated but not limited by the following examples in which percentages are by weight.

EXAMPLES 1-6

In each of these examples, an aqueous slurry was made containing 15% of a cleaner copper-molybdenum concentrate assaying 26% Cu and 2.7% Mo from Anamax Twin Buttes Mine, Arizona, U.S.A. The slurry was adjusted to pH 10 with lime and was conditioned with a given depressant as shown in Table I for 20 minutes. One minute before floating, kerosene was added as collector in the amount of 2 pounds per ton of concentrate solids. Frother was then added as required and the slurry was floated for 5 minutes. In examples 1 to 4 which are provided for comparison purposes, either no depressant or a prior art depressant has been used. The floatation results obtained in examples 1 to 6 are shown in Table I.

TABLE I

| | Depressant | | Concentrate | Mo | Mo Grade | |
|---|---|---|---|---|---|---|
| Example No. | Name | lb/ton of concentrate | Percent Floated | Percent Recovered | Percent Floated | Percent in Tail |
| 1 | None | — | 85 | 86 | 3.0 | 2.6 |
| 2 | Sodium hydrosulphide | 100 | 14.7 | 89 | 18.3 | .4 |
| 3 | Sodium thioglycollate | 5 | 20.7 | 86 | 9.1 | .4 |
| 4 | Thioglycerol | 5 | 42.1 | 85 | 3.5 | .8 |
| 5 | Cysteine | 5 | 16.0 | 84 | 13.0 | .5 |
| 6 | Thiobarbituric acid | 5 | 17.9 | 92 | 15.3 | .3 |

The relatively high doses of depressants required in Examples 2-6 can be explained by the fact that the concentrate which was in a highly divided state suffered from some oxidation during storage. This oxidation affected the response of the minerals to depressants, in particular to sodium hydrosulphide. Indeed, in the laboratory up to 100 pounds of sodium hydrosulphide per ton of concentrate was required for complete copper depression, whereas normal mill usage is in the range of 15 to 30 pounds per ton of concentrate.

EXAMPLES 7-15

The same procedure was followed as in Examples 1 to 6 except that the concentrate was Gaspe A-rougher Cu-Mo concentrate assaying 10% Cu and 0.4% Mo from Gaspe Copper Mine, Province of Quebec, Canada. In Examples 7, 8 and 12 which are provided for comparison either no depressant or sodium hydrosulphide or sodium thioglycollate was used while in each of Examples 9 to 11 and 13 to 15 a depressant of the invention was used. The flotation results are shown in Table II.

TABLE II

| Example No. | Depressant Name | Depressant lb/ton of concentrate | Concentrate Percent Floated | Mo Percent Recovered | Mo Grade Percent Floated | Mo Grade Percent in Tail |
|---|---|---|---|---|---|---|
| 7 | None | — | 23.5 | 91 | 1.6 | .05 |
| 8 | Sodium hydrosulphide | 20 | 7.5 | 84 | 5.1 | .08 |
| 9 | Thiobarbituric acid | 0.25 | 2.2 | 57 | 8.0 | .13 |
| 10 | Thiobarbituric acid | 0.125 | 4.1 | 75 | 5.5 | .08 |
| 11 | Cysteine | 0.25 | 5.8 | 81 | 4.3 | .06 |
| 12 | Sodium thioglycollate | 0.25 | 22.7 | 91 | 1.7 | .05 |
| 13 | 2-mercapto-3-pyridinol | 0.10 | 2.5 | 52 | 8.1 | .19 |
| 14 | 2-mercapto-3-pyridinol | 0.05 | 9.0 | 80 | 4.1 | .09 |
| 15 | Trithiocyanuric acid | 0.5 | 5.8 | 82 | 5.8 | .08 |

EXAMPLES 16–25

The same procedure was followed as in Examples 1 to 6 except that the concentrate was Gaspe B cleaner Cu-Mo concentrate assaying 22% Cu and 0.7% Mo from Gaspe Copper Mine, Province of Quebec, Canada. The natural pH of the slurry being 10, it did not have to be adjusted. Again Examples 16 and 17 wherein either no depressant or sodium hydrosulphide was used are provided for comparison purposes. The flotation results are shown in Table III.

TABLE III

| Example No. | Depressant Name | Depressant lb/ton of concentrate | Concentrate Percent Floated | Mo Percent Recovered | Mo Grade Percent Floated | Mo Grade Percent in Tail |
|---|---|---|---|---|---|---|
| 16 | None | — | 52.5 | 58 | .7 | .7 |
| 17 | Sodium hydrosulphide | 40 | 4.0 | 87 | 12.1 | .07 |
| 18 | Thiobarbituric acid | 1 | 20.5 | 89 | 2.5 | .08 |
| 19 | Cysteine | 2 | 17.0 | 68 | 3.1 | .27 |
| 20 | 2-thiouracil | 1 | 3.4 | 67 | 14.6 | .25 |
| 21 | 2-thiouracil | 0.5 | 8.3 | 84 | 8.2 | .15 |
| 22 | Methionine | 1 | 9.1 | 77 | 6.1 | .8 |
| 23 | Methionine | 2 | 10.3 | 77 | 5.6 | .20 |
| 24 | Dithiooxamide | 1 | 15.1 | 58 | 3.0 | .39 |
| 25 | Ethanesulphonic acid-amidinothio | 5 | 6.2 | 82 | 10.6 | .16 |

EXAMPLES 26–37

The same procedure was followed as in Examples 1 to 6 except that the concentrate was Gaspe C cleaner concentrate assaying 27% Cu and 1.7% Mo. The natural pH of the slurry being 10, it did not have to be adjusted. Again Examples 26 and 27 are provided for comparison purposes. The flotation results are shown in Table IV.

TABLE IV

| Example No. | Depressant Name | Depressant lb/ton of concentrate | Concentrate Percent Floated | Mo Percent Recovered | Mo Grade Percent Floated | Mo Grade Percent in Tail |
|---|---|---|---|---|---|---|
| 26 | None | — | 58.0 | 81 | 2.6 | .84 |
| 27 | Sodium hydrosulphide | 30 | 9.4 | 91 | 15.5 | .11 |
| 28 | 2-thiouracil | 1 | 10.3 | 92 | 14.3 | .14 |
| 29 | 6-methyl-2-thiouracil | 1 | 17.9 | 94 | 9.3 | .13 |
| 30 | " | 2 | 14.9 | 94 | 11.4 | .13 |
| 31 | Thiobarbituric acid | 1 | 11.7 | 94 | 14.8 | .13 |
| 32 | Thioorotic acid | 1 | 11.0 | 92 | 15.0 | .15 |
| 33 | Thiohydantoin | 1 | 14.2 | 93 | 12.3 | .14 |
| 34 | Methionine | 1 | 21.1 | 91 | 8.0 | .21 |
| 35 | 6-amino-2-thiouracil | 0.5 | 4.8 | 79 | 23.0 | .31 |
| 36 | Pseudothiohydantoin | 1 | 7.5 | 80 | 19.9 | .40 |
| 37 | Rhodanine-N-acetic acid | 1 | 19.5 | 79 | 6.9 | .44 |

EXAMPLES 38–44

The same procedure was followed as in Examples 1 to 6 except that the concentrate was cleaner concentrate from Utah Island Copper, Province of British Columbia, Canada, assaying 23% Cu and 0.65% Mo. The flotation results are shown in Table V.

TABLE V

| Example No. | Depressant Name | Depressant lb/ton of concentrate | Concentrate Percent Floated | Mo Percent Recovered | Mo Grade Percent Floated | Mo Grade Percent in Tail |
|---|---|---|---|---|---|---|
| 38 | None | — | 63.8 | 81 | 0.8 | .34 |
| 39 | Sodium hydrosulphide | 5 | 6.4 | 75 | 8.9 | .21 |
| 40 | Sodium hydrosulphide | 10 | 4.4 | 61 | 10.2 | .29 |
| 41 | Thiobarbituric acid | 1 | 3.5 | 63 | 12.0 | .26 |
| 42 | Cysteine | 0.5 | 4.3 | 71 | 11.4 | .21 |

TABLE V-continued

| Example No. | Depressant Name | lb/ton of concentrate | Concentrate Percent Floated | Mo Percent Recovered | Mo Grade Percent Floated | Mo Grade Percent in Tail |
|---|---|---|---|---|---|---|
| 43 | Acetic acid-aminodithio | 0.5 | 5.4 | 77 | 8.6 | .15 |
| 44 | 2-thiouracil | 0.5 | 6.3 | 78 | 7.7 | .14 |

EXAMPLES 45–48

In these examples, an aqueous slurry was made containing 50% of a Gaspe Copper Mines cleaner concentrate assaying 28% Cu and 1.4% Mo and fresh from the mill. The slurry was adjusted to pH 11.7 with caustic soda and was conditioned for 20 minutes with 0.1 pound of activated carbon per ton of concentrate. The depressant was then added and the slurry was conditioned for 5 more minutes. Two drops of fuel oil were added one minute before floating. Frother was then added and the slurry was floated for 5 minutes. The flotation results appear in Table VI.

TABLE VI

| Example No. | Depressant Name | lb/ton of concentrate | Concentrate Percent Floated | Mo Percent Recovered | Mo Grade Percent Floated | Mo Grade Percent in Tail |
|---|---|---|---|---|---|---|
| 45 | Sodium hydrosulphide | 12.1 | 5.4 | 71 | 19.7 | .45 |
| 46 | 2-thiouracil | 0.6 | 3.8 | 70 | 25.4 | .44 |
| 47 | 2-thiouracil | 1.3 | 4.8 | 82 | 23.5 | .26 |
| 48 | 2-thiohydantoin | 0.7 | 5.8 | 71 | 19.2 | .48 |

EXAMPLES 49–55

The same procedure was followed as in Examples 1 to 6 except that the concentrate was Gaspe D cleaner concentrate assaying 30% Cu and 1.3% Mo from Gaspe Copper Mines, Province of Quebec, Canada and after addition of the depressant, the slurry was conditioned for 10 minutes rather than 20 minutes. The flotation results are shown in Table VII.

TABLE VII

| Example No. | Depressant Name | lb/ton of concentrate | Concentrate Percent floated | Mo Percent recovered | Mo Grade Percent floated | Mo Grade Percent in Tail |
|---|---|---|---|---|---|---|
| 49 | None | — | 68.9 | 93 | 1.5 | .23 |
| 50 | 2-thiouracil | 0.5 | 5.4 | 86 | 19.7 | .19 |
| 51 | Solubilized pseudo-thiocyanogen | 1.0 | 3.1 | 81 | 26.3 | .19 |
| 52 | D-glucose-thiourea adduct | 0.5 | 4.4 | 84 | 22.6 | .20 |
| 53 | 2-imino-4-oxo-5-thiazolidineacetic acid | 0.5 | 5.1 | 90 | 19.8 | .12 |
| 54 | Thioparabanic acid | 0.5 | 35.2 | 94 | 3.9 | .14 |
| 55 | 3-amino-rhodanine | 0.5 | 19.4 | 93 | 6.8 | .12 |

EXAMPLES 56 and 57

Endako ore (Endako Mines Division of Canex Placer Limited, British Columbia, Canada) contains 0.16% molybdenum sulphide together with minor amounts of copper sulphide minerals. Flotation of the ore with fuel oil yields a rougher concentrate containing approximately 17% Mo with 0.2 to 1.0% Cu. To separate Mo and Cu from each other, the rougher concentrate is then subjected to a complex series of cleaner floats and regrinds using sodium cyanide to depress copper and sodium silicate to depress silica.

A sample of Endako rougher concentrate was obtained for testing by treatment in accordance with the method of the present invention. Thus, an aqueous slurry was made containing 15% of the Endako rougher concentrate which assayed 16.8% Mo and 0.28% Cu. The slurry was adjusted to pH 10 with lime and then conditioned with 0.2 pound per ton sodium silicate plus the copper depressant for 5 minutes. One minute before floating, kerosene was added as collector in the amount of 2 pounds per ton of concentrate solids. Frother was then added as required and the slurry was floated for 5 minutes. The floation results obtained are shown in Table VIII.

TABLE VIII

| Example No. | Depressant Name | lb/ton of concentrate | | Wt. % | Mo Grade | Mo % recovered | Cu Grade | Cu % recovered |
|---|---|---|---|---|---|---|---|---|
| 56 | Sodium cyanide | 4.8 | concentrate | 34.0 | 41.3 | 77 | .25 | 32 |
| | | | tail | 66.0 | 6.4 | 23 | .27 | 68 |
| 57 | 2-thiouracil | 0.25 | concentrate | 33.3 | 37.6 | 81 | .26 | 31 |
| | | | tail | 66.7 | 4.3 | 19 | .29 | 69 |

EXAMPLES 58–60

Gaspe Copper Mines employ sodium hydrosulphide for rougher Cu - Mo separation, but use sodium cyanide in the later cleaning stages to allow Mo to float while depressing Cu.

A sample of concentrate from rougher Cu - Mo separation at Gaspe (sodium hydrosulphide had been used as depressant in the rougher separation) was taken and floated in Gaspe's mill laboratory to compare sodium cyanide and 2-thiouracil as cleaner depressants. The ore pulp was left at its natural pH of 11, conditioned with the depressant for 5 minutes and floated 5 minutes. No other reagent were employed. The flotation results are shown in Table IX.

It appears clearly from above Examples 56 to 60 that 2-thiouracil gives equal or superior metallurgy than higher additions of sodium cyanide. The use of 2-thiouracil has an additional advantage over sodium cyanide: cyanide solubilizes some of the copper causing severe toxic effluent problems for mills, whereas 2-thiouracil does not dissolve the copper and would not produce toxic effluents.

TABLE IX

| Example No. | Depressant Name | Depressant lb/ton of concentrate | | Weight % | Mo Grade | Mo % recovered | Cu Grade | Cu % recovered |
|---|---|---|---|---|---|---|---|---|
| 58 | Sodium cyanide | 0.79 | concentrate | 17.5 | 20.0 | 62 | 12.4 | 11 |
| | | | tail | 82.5 | 2.6 | 38 | 22.8 | 89 |
| 59 | Sodium cyanide | 1.58 | concentrate | 21.4 | 18.8 | 68 | 13.7 | 14 |
| | | | tail | 78.6 | 2.4 | 32 | 22.8 | 86 |
| 60 | 2-thiouracil | 0.39 | concentrate | 17.7 | 24.8 | 69 | 10.4 | 9 |
| | | | tail | 82.3 | 2.4 | 31 | 21.5 | 91 |

The embodiments of the invention in which an exclusive property or privilege is claimed are defined as follows:

1. A process for separating molybdenite from copper sulphide and other metal sulphide minerals with which it is associated in a metallurgical concentrate, which comprises depressing the copper sulphide and other metal sulphide minerals with from about 0.1 to about 5.0 pounds per ton of concentrate solids of a reagent selected from 2-thiouracil, 6-amino-2-thiouracil, 6-methyl-2-thiouracil, 2-thiobarbituric acid, thioorotic acid, 2-thiohydantoin, pseudothiohydantoin, 2-amino-4-oxo-5-thiazolidineacetic acid, D-glucose thiourea adduct, cysteine, methionine, amidinothioacetic acid, amidinothioethane sulphonic acid, 2-mercapto-3-pyridinol, rhodanine-N-acetic acid, N-amino-rhodamine and any alkali metal or acid salts of these, selectively floating molybdenite from the depressed copper sulphide and other depressed metal sulphide minerals and recovering the resulting flotation concentrate of molybdenite.

2. A process as claimed in claim 1 wherein the reagent is present in an amount of 0.1 to 1.0 pound per ton of concentrate solids.

3. A process as claimed in claim 2 wherein the reagent is selected from 2-thiouracil and 6-methyl-2-thiouracil.

4. A process as claimed in claim 1 wherein a hydrocarbon oil is used to assist in the flotation and recovery of the molybdenite.

5. A process as claimed in claim 4 wherein the hydrocarbon oil is selected from kerosene and fuel oil.

* * * * *